US010328438B2

(12) United States Patent
Yoshida

(10) Patent No.: US 10,328,438 B2
(45) Date of Patent: Jun. 25, 2019

(54) TUBE RACK OF A CENTRIFUGAL SEPARATOR HAVING BOTTOM RUBBER MEMBERS

(71) Applicant: KUBOTA MANUFACTURING CORPORATION, Tokyo (JP)

(72) Inventor: Hideki Yoshida, Fujioka (JP)

(73) Assignee: KUBOTA MANUFACTURING CORPORATION, Tokyo (JP)

( * ) Notice: Subject to any disclaimer, the term of this patent is extended or adjusted under 35 U.S.C. 154(b) by 0 days.

(21) Appl. No.: 15/764,300

(22) PCT Filed: Jul. 20, 2016

(86) PCT No.: PCT/JP2016/071254
§ 371 (c)(1),
(2) Date: Mar. 28, 2018

(87) PCT Pub. No.: WO2017/056650
PCT Pub. Date: Apr. 6, 2017

(65) Prior Publication Data

US 2018/0272361 A1 Sep. 27, 2018

(30) Foreign Application Priority Data

Sep. 29, 2015 (JP) ..... 2015-190798

(51) Int. Cl.
*B01L 9/06* (2006.01)
*B04B 5/04* (2006.01)

(52) U.S. Cl.
CPC ..... *B04B 5/0414* (2013.01); *B01L 9/06* (2013.01); *B04B 5/0421* (2013.01);
(Continued)

(58) Field of Classification Search
CPC ..... B04B 5/0414; B04B 5/0421; B04B 9/00; B04B 5/02; B04B 2005/0435; B01L 9/06
(Continued)

(56) References Cited

U.S. PATENT DOCUMENTS 2,110,308 A * 3/1938 Nelson ..... G01K 5/06 374/192
3,674,198 A * 7/1972 Eberle ..... B04B 5/04 211/74

(Continued)

FOREIGN PATENT DOCUMENTS

DE 202013006223 U1 * 11/2014
JP S54-021878 U1 2/1979

(Continued)

OTHER PUBLICATIONS

"International Search Report," PCT/JP2016/071254 dated Oct. 11, 2016 (2 pages).

(Continued)

*Primary Examiner* — Charles Cooley
(74) *Attorney, Agent, or Firm* — Womble Bond Dickinson (US) LLP

(57) ABSTRACT

A tube rack of a centrifugal separator, in which a bottom rubber portion can be readily mounted and readily replaced, and yet such bottom rubber portion cannot be easily separated. The tube rack includes a holder (14) including a plurality of tube holes (12) each configured to accommodate a tube that is used for a sample and each includes an opening at one end portion of the holder serving as a tube insertion side, and an opening at a bottom portion of the holder that is at the other end. The tube rack includes a bottom rubber portion (15) including a plurality of bottom rubber members (25) each fits in the tube hole (12), and including connecting pieces (24). The tube rack includes a base (13) formed in a cylindrical shape having a bottom configured to accommo- (Continued)

date and detachably hold the holder (14) and the bottom rubber portion (15), and to be inserted into a bucket of the centrifugal separator.

1 Claim, 12 Drawing Sheets

(52) U.S. Cl.
CPC . *B01L 2200/087* (2013.01); *B01L 2300/0851* (2013.01); *B04B 2005/0435* (2013.01)

(58) Field of Classification Search
USPC ..... 494/20–21
See application file for complete search history.

(56) References Cited

U.S. PATENT DOCUMENTS

| | | | | | |
|---|---|---|---|---|---|
| 4,030,663 | A * | 6/1977 | Conn | B04B 5/0421 | 206/427 |
| 4,032,066 | A * | 6/1977 | Wright | B04B 5/0421 | 206/499 |
| 4,124,122 | A * | 11/1978 | Emmitt | B01L 9/06 | 211/74 |
| RE30,276 | E * | 5/1980 | Rohde | B01L 3/50825 | 211/74 |
| 4,963,493 | A * | 10/1990 | Daftsios | B01D 11/04 | 206/569 |
| 5,950,832 | A * | 9/1999 | Perlman | B01L 9/06 | 206/446 |
| 10,239,061 | B2 * | 3/2019 | Weber-Hovendahl | B01L 9/06 | |
| 2018/0021784 | A1 * | 1/2018 | Weber-Hovendahl | B01L 9/06 | 211/74 |
| 2018/0169667 | A1 * | 6/2018 | Yoshida | B04B 5/0421 | |
| 2018/0272361 | A1 * | 9/2018 | Yoshida | B04B 5/0414 | |

FOREIGN PATENT DOCUMENTS

| | | | | | |
|---|---|---|---|---|---|
| JP | S57-199061 | U1 | | 12/1982 | |
| JP | 06285390 | A | * | 10/1994 | B04B 5/0421 |
| JP | 08266933 | A | * | 10/1996 | |
| JP | 2509308 | Y | | 11/1996 | |
| JP | 2003-080115 | A | | 3/2003 | |
| JP | 2007-021283 | A | | 2/2007 | |
| JP | 2007-021356 | A | | 2/2007 | |
| JP | 2007021283 | A | * | 2/2007 | |
| JP | 2008-200595 | A | * | 9/2008 | |
| JP | 5690448 | B1 | * | 3/2015 | B01J 19/00 |
| JP | 2017-6840 | | * | 1/2017 | |
| JP | 2017-64596 | | * | 4/2017 | |

OTHER PUBLICATIONS

"International Preliminary Report on Patentability," PCT/JP2016/071254 dated Apr. 3, 2018 (6 pages).

European Search Report and Search Opinion Received for EP Application No. 16850827.3, dated Mar. 21, 2019, 7 pages.

* cited by examiner

TUBE RACK OF A CENTRIFUGAL SEPARATOR HAVING BOTTOM RUBBER MEMBERS

TECHNICAL FIELD

The present invention relates to a tube rack of a centrifugal separator for holding tubes each containing a sample to carry out a centrifugal treatment.

BACKGROUND ART

Conventionally, there are mainly provided an angle rotor and a swinging rotor as rotors used for a centrifugal separator. In the angle rotor, a constant value of an angle is used for the angle of a tube hole for holding each tube containing a sample to carry out a centrifugal treatment. The swinging rotor is formed by a rotor yoke and a bucket. The bucket is used to accommodate tubes each containing a sample, and detachably and swingably attached to the rotor yoke. The tubes are accommodated in the bucket while they are held in a tube rack. The bucket is swung up by the centrifugal force up to an angle of 0 to 90° along with the rotation of the rotor yoke.

The tubes used for the swinging rotor are generally, mainly made of glass or plastic.

In a conventional tube rack, one or a plurality of individual tube holes is formed to hold a tube. A tube containing a sample is inserted into the tube hole, and held.

There are mainly two reasons why the tube is inserted into the individual tube hole. The first reason is to prevent, if one of the tubes is damaged during the centrifugal treatment, any effect of the damage from spreading to other adjacent tubes.

The second reason is to keep the sample contained in the damaged tube within the tube rack so as to prevent toxic substance and toxic bacteria from adhering to the bucket and the like.

Each tube hole of the tube rack is often formed as a non-through hole conforming to the outer shape and bottom shape of the tube, that is, a blind hole shape. The reason for this is to prevent the tube from being deformed or damaged by the centrifugal force.

In general, tube racks are made of plastic, and some are cut out by machining and some are formed by resin molding. Some of the tube racks formed by resin molding include tube holes each divided into an upper portion, middle portion, and bottom surface, and some others include tube holes each including no middle portion and supporting a tube by only an upper portion and bottom surface.

There is provided a conventional tube rack in which a bottom rubber portion (elastic body) is inserted into the bottom surface of a tube hole. This tube rack is used when the strength of the tube bottom surface is low and the bottom shape varies for each tube.

When the bottom shape of a tube hole contacting a tube in the tube rack is considerably different from the bottom shape of the tube, an excessive force is applied to a portion of the tube bottom surface, and the tube bottom portion is unwantedly deformed or damaged. As for the tube rack in which a bottom rubber portion is inserted into the bottom surface of the tube hole, the bottom rubber portion can be deformed in accordance with the shape of the tube bottom surface, and it is thus possible to prevent an excessive force from being applied to the portion of the tube bottom surface.

As a conventional tube rack including a bottom rubber portion, there is provided, for example, a tube rack described in patent literature 1. The bottom rubber portion disclosed in patent literature 1 includes a film-like projection or fin-shaped projection around a cushion portion contacting the bottom portion of the tube. An arrangement in which the film-like projection or fin-shaped projection is pressed against the hole wall of the tube hole is adopted. By forming the film-like projection or fin-shaped projection in the bottom rubber portion, it is possible to prevent, when the tube is removed from the tube hole, the bottom rubber portion from being separated from the tube hole together with the tube.

RELATED ART LITERATURE

Patent Literature

Patent Literature 1: Japanese Utility Model Registration No. 2509308

DISCLOSURE OF INVENTION

Problem to be Solved by the Invention

The tube rack including the bottom rubber portion described in patent literature 1 has three following problems.

The first problem is that the assembly operation of the tube rack will be complicated. In the conventional tube rack, a bottom rubber portion is individually inserted into the opening of each individual tube hole. Therefore, an operation of inserting a bottom rubber portion into a tube hole needs to be performed the number of times corresponding to the number of tube holes, thereby causing greater burden in carrying out the insertion operation. Especially, as described in patent literature 1, if the film-like projection or fin-shaped projection is formed in the bottom rubber portion, a frictional force is generated by a contact with the hole wall surface of the tube hole, and thus a tool is required in order to insert the bottom rubber portion into the tube hole.

The second problem is that the bottom rubber portion may be separated or lost. The bottom rubber portion described in patent literature 1 includes, as a separation preventive measure, the film-like projection or fin-shaped projection to prevent the bottom rubber portion from being separated from the tube hole. However, since the separation preventive measure relies on friction between the hole wall of the tube hole and the film-like projection or fin-shaped projection, the bottom rubber portion may be separated when fraction resistance decreases caused by an aging degradation of the bottom rubber portion. When a centrifugal treatment of another tube is performed in a state in which the bottom rubber portion is being separated, the tube can be damaged at high probability. When the bottom rubber portion is lost, the rotation of the rotor becomes unbalanced, and a vibration occurs during the rotation of the rotor. When a vibration occurs in the rotor, the life of a motor decreases, and noise is generated.

The third problem is the difficulties in replacing the bottom rubber portion. The bottom rubber portion may deteriorate or be damaged with use by the user. The bottom rubber portion described in patent literature 1 is inserted into the bottom of the tube hole formed from a blind hole, and locked by the film-like projection or fin-shaped projection. Therefore, it is difficult to detach the bottom rubber portion for replacement.

The present invention has been made to solve these problems, and has as its object to provide a tube rack of a centrifugal separator, in which a bottom rubber portion can be readily mounted, and readily replaced, and yet such a bottom rubber portion cannot be easily separated.

Means of Solution to the Problem

In order to achieve the above object, according to the present invention, there is provided a tube rack of a centrifugal separator, comprising a holder including a plurality of tube holes each configured to accommodate a tube that is used for a sample, and the plurality of tube holes each includes an opening at one end portion of the holder serving as a tube insertion side and an opening at a bottom portion of the holder that is at the other end, a bottom rubber main body including a plurality of bottom rubber members each fits in an opening of the bottom portion of each of the plurality of tube holes, and including connecting portions each configured to connect the plurality of bottom rubber members that are adjacent to each other, and a base formed in a cylindrical shape that has a bottom configured to accommodate and detachably hold the holder and the bottom rubber main body, and to be inserted into a bucket of the centrifugal separator.

Effect of the Invention

According to the present invention, when the connecting portions of the bottom rubber main body abut against the hole walls of the tube holes, the bottom rubber members are regulated so that the bottom rubber members do not come off the tube holes. Unlike the conventional technique, the separation preventive measure does not rely on friction between the bottom rubber portion and the hole wall surfaces of the tube holes. Thus, even if the bottom rubber members deteriorate over time, they will not be separated. Therefore, it is possible to prevent the rotation of the rotor from becoming unbalanced caused by the loss of the bottom rubber members. As a result, it is possible to suppress a decrease in life of the motor for driving the rotor.

According to the present invention, since the plurality of bottom rubber members are connected by the connecting portions to form one bottom rubber main body, it is unnecessary to insert each bottom rubber member into each tube hole when incorporating the bottom rubber members in the holder. Therefore, even though the plurality of bottom rubber members is provided, it is possible to provide the tube rack of the centrifugal separator, that has high assemblability.

An operation of replacing the deteriorated bottom rubber members can be readily performed because by detaching the holder from the base, the bottom rubber main body can be exposed.

Therefore, according to the present invention, it is possible to provide the tube rack of the centrifugal separator, in which the bottom rubber portion can be readily mounted and readily replaced, and yet the bottom rubber portion cannot be easily separated.

BEST MODE FOR CARRYING OUT THE INVENTION

An embodiment of a tube rack of a centrifugal separator according to the present invention will be described in detail below with reference to FIGS. 1 to 16.

Figure 1:
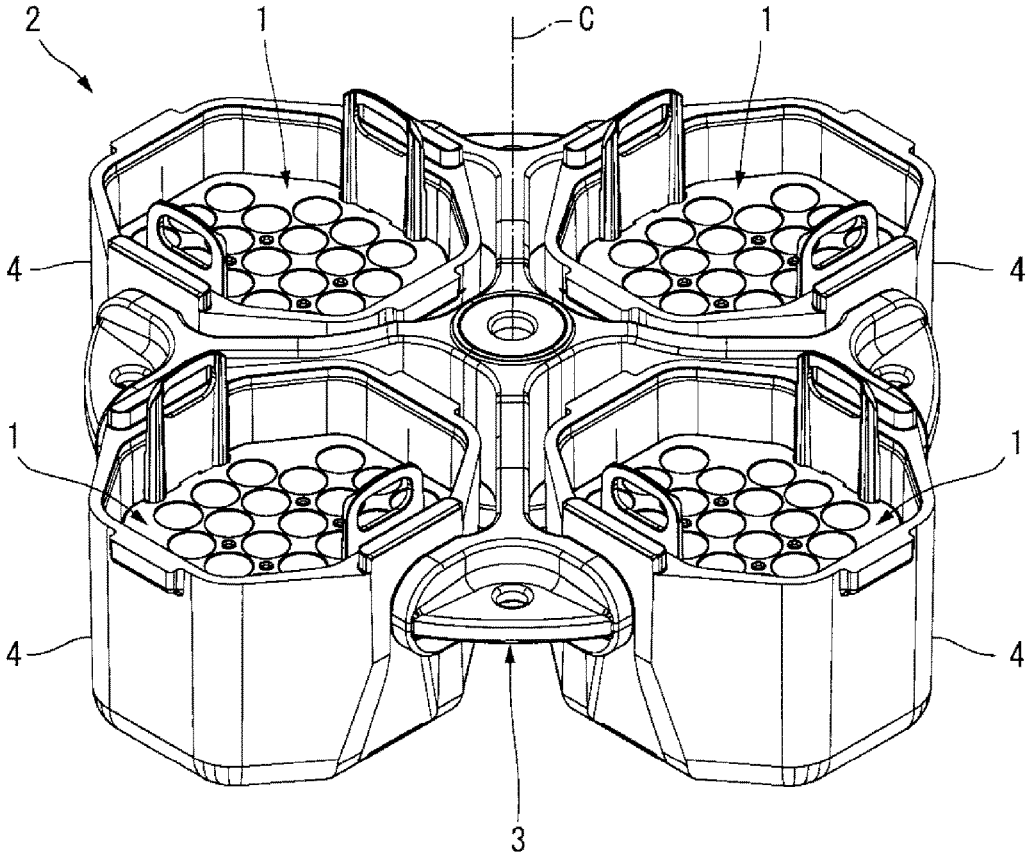
FIG. 1 is a perspective view showing a swinging rotor on which tube racks are mounted according to the present invention.
Figure 2:
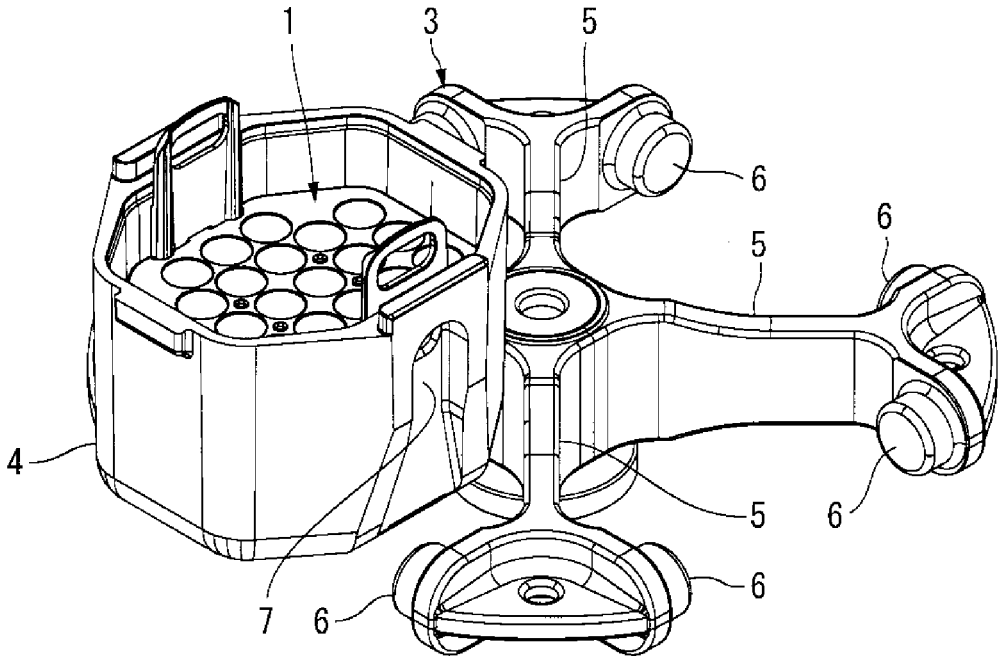
FIG. 2 is a perspective view showing a state in which a bucket is mounted on a rotor yoke.

Tube racks 1 shown in FIG. 1 are mounted on a swinging rotor 2 for the centrifugal separator. The swinging rotor 2 is formed by a rotor yoke 3 and a plurality of buckets 4. The rotor yoke 3 is driven by a motor (not shown), and rotates about an axis indicated by a one-dot dashed line C in FIG. 1. The rotor yoke 3 includes a plurality of arms 5, as shown in FIG. 2. Each of the distal end portions of the arms 5 is provided with trunnion pins 6.

Each bucket 4 is formed in a cylindrical shape having a bottom, and opening upward. In the bucket 4, trunnion pin grooves 7 in which the trunnion pins 6 of the rotor yoke 3 are engaged are formed. The bucket 4 is held by the rotor yoke 3 to be swingable about the trunnion pins 6.

The swinging rotor 2 is mounted on the motor shaft of the centrifugal separator (not shown), and rotates integrally with the motor shaft. When the swinging rotor 2 rotates, each bucket 4 is swung up about the trunnion pins 6 in a direction in which the bucket bottom surface moves away from the rotation center.

Figure 3:
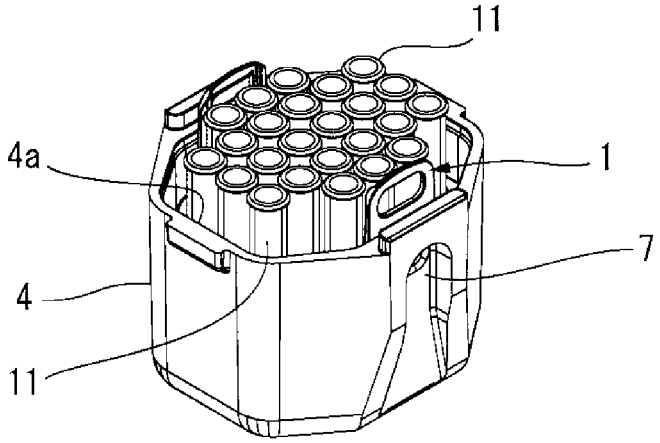
FIG. 3 is a perspective view showing a state in which the tube rack into which tubes are inserted is mounted on the bucket.
Figure 4:
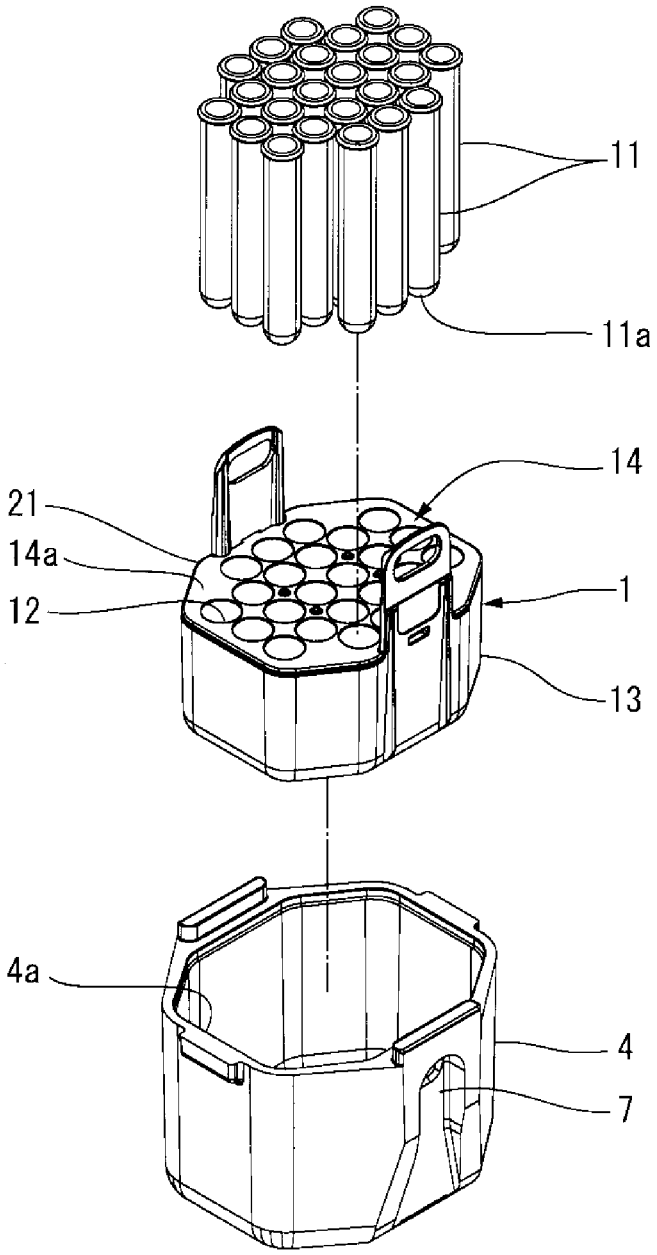
FIG. 4 is an exploded perspective view showing a state in which the tube rack and tubes are removed from the bucket.

When a centrifugal treatment is performed, a plurality of tubes 11 are accommodated in the bucket 4 via the tube rack 1, as shown in FIG. 3. Each tube 11 contains a sample to carry out the centrifugal treatment, and is formed in a pipe shape having a closed end and an open end, as shown in FIG. 4. The outer surface of a bottom portion 11*a* serving as the closed end of the tube 11 is formed in a hemispherical shape that is convex toward the opposite side of the open end. As the tube 11, a tube made of glass or plastic is mainly used.

The tubes 11 are respectively inserted into tube holes 12 of the tube rack 1 from above, and held by the tube rack 1. The tube rack 1 holding the plurality of tubes 11 is inserted into an opening 4*a* of the bucket 4 from above, and held by the bucket 4.

Figure 5:
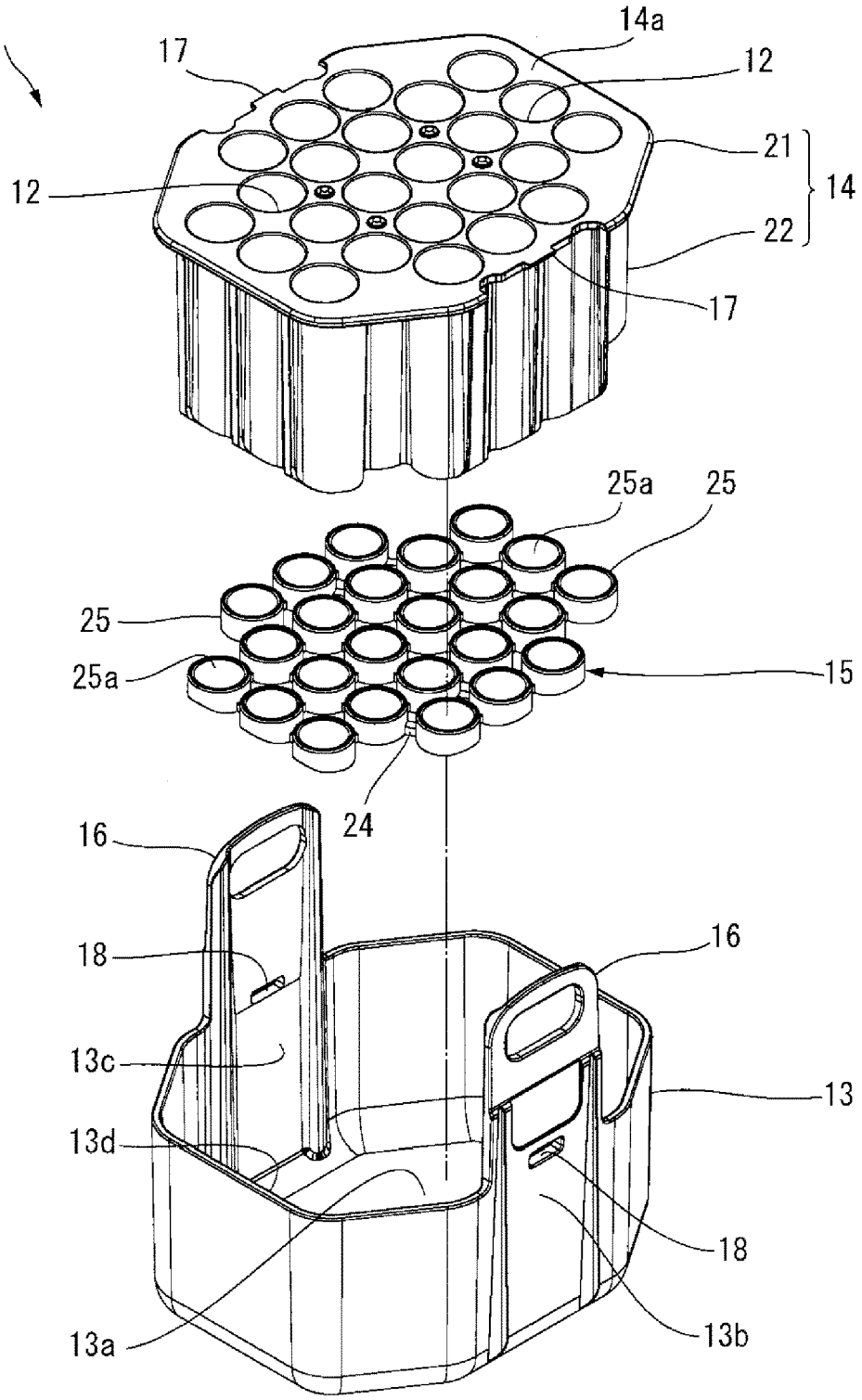
FIG. 5 is an exploded perspective view showing the tube rack when viewed from obliquely above.
Figure 6:
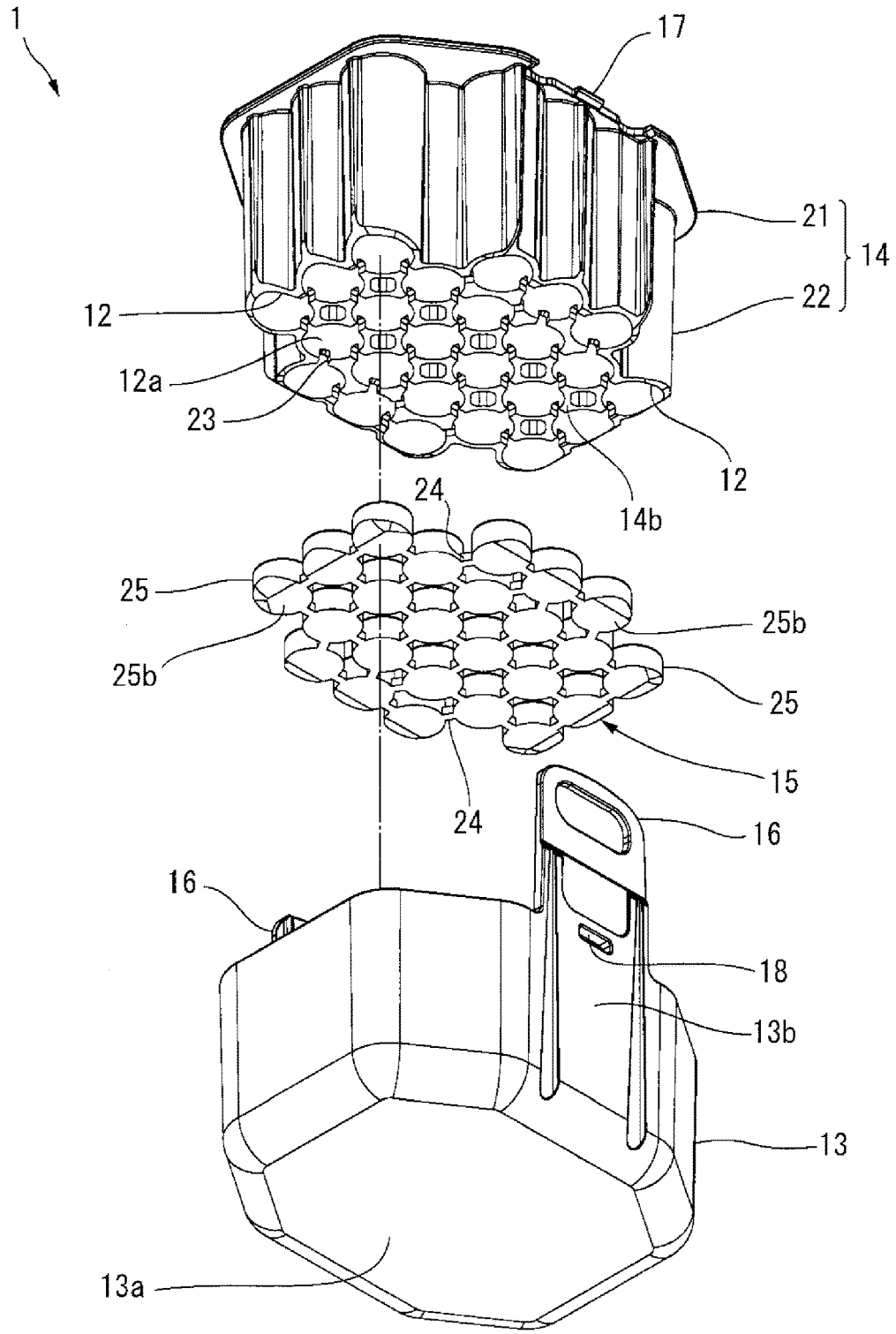
FIG. 6 is an exploded perspective view showing the tube rack when viewed from obliquely below.

As shown in FIGS. 5 and 6, the tube rack 1 is formed by combining three parts. The three parts are a base 13 located lowermost in FIGS. 5 and 6, a holder 14 located uppermost, and a bottom rubber portion 15 located between the base 13 and the holder 14. In this embodiment, the bottom rubber portion 15 corresponds to the "bottom rubber main body" of the present invention. Although details will be described later, the bottom rubber portion 15 is mounted on the holder 14 from below. Furthermore, the holder 14 is mounted on the base 13 from above while the bottom rubber portion 15 is mounted on the holder 14.

The base 13 is formed in a box shape having a pair of handle portions 16. More specifically, the base 13 is formed in a cylindrical shape having a bottom that has a base bottom plate 13*a* as a bottom and is open upward. The base 13 is formed in a shape that can be fitted in the bucket 4 from above, and has a function of accommodating and detachably holding the holder 14 and the bottom rubber portion 15 (to be described later).

The handle portions 16 project upward from two facing side walls 13*b* and 13*c* of the base 13. In each handle portion 16, a hole 18 that is engaged with a hook portion 17 of the holder 14 (to be described later) is formed. This hole 18 is formed at a height almost equal to that of a base opening 13*d*.

Figure 7A:
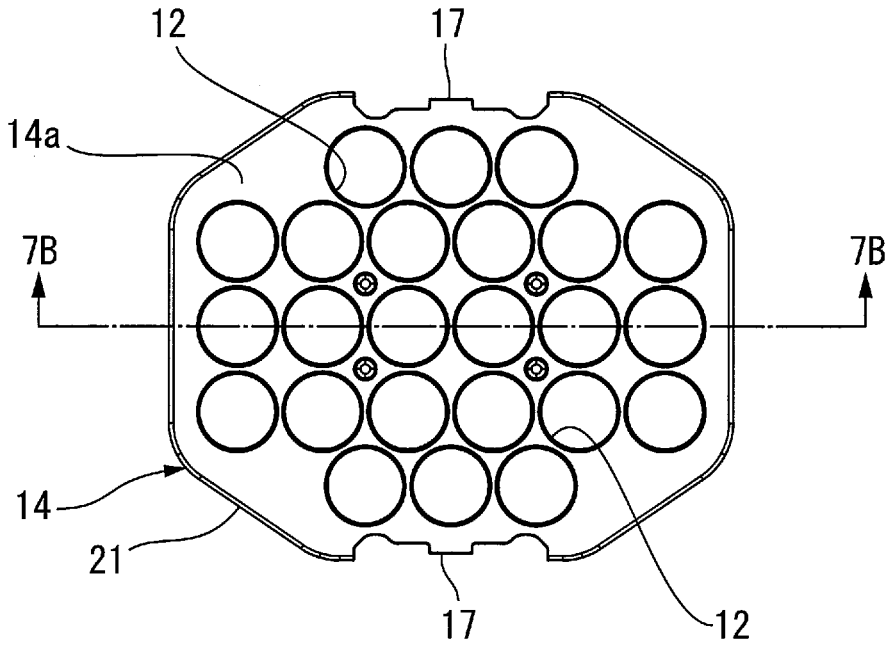
FIG. 7A is a plan view showing a holder.
Figure 7B:
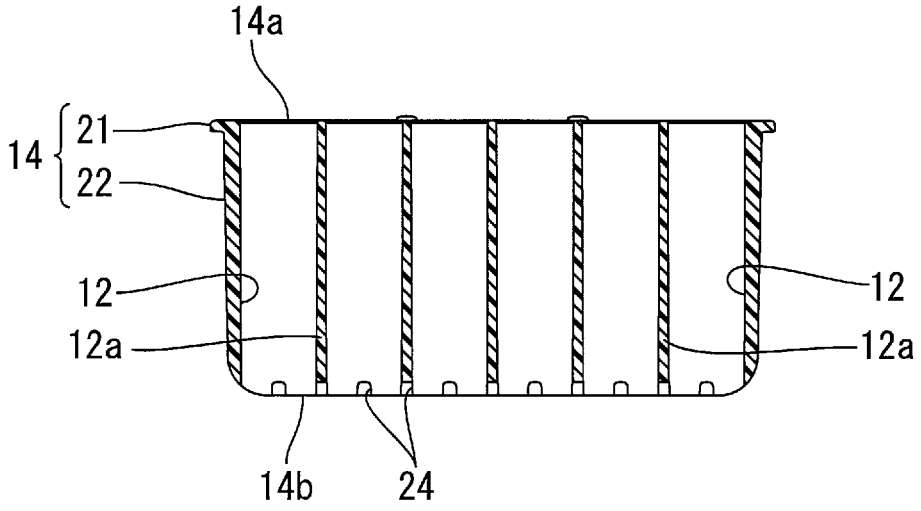
FIG. 7B is a sectional view taken along a line 7B-7B in FIG. 7A.
Figure 7C:
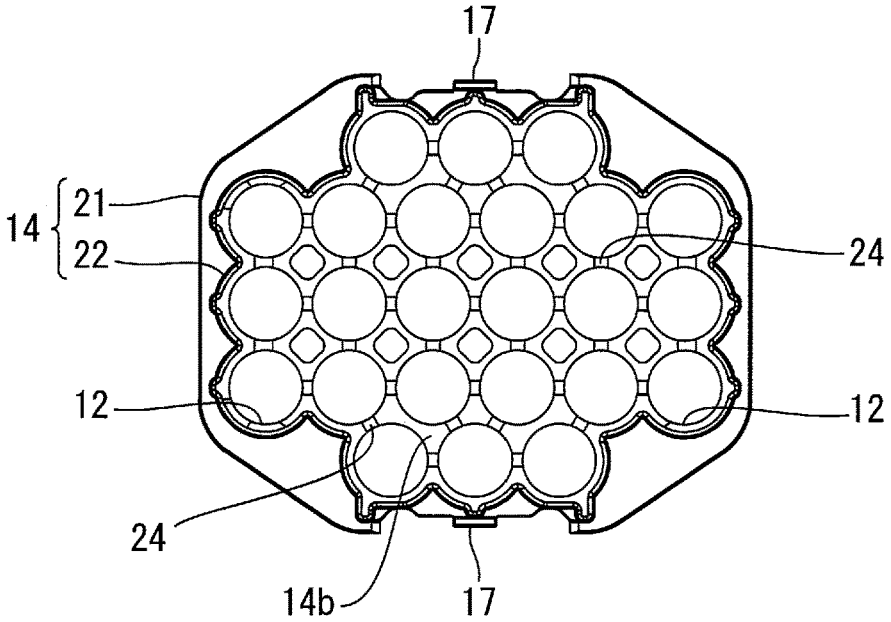
FIG. 7C is a bottom view showing the holder.

As shown in FIGS. 5 to 7, the holder 14 includes an upper plate 21 forming a holder upper surface 14*a*, and a holder main body 22 extending downward from the upper plate 21. The upper plate 21 and the holder main body 22 are integrally formed by integral molding using a plastic material. As shown in FIG. 4, the upper plate 21 closes the base opening 13*d* while the holder 14 is mounted on the base 13. On each of two side portions of the upper plate 21, the above-described hook portion 17 is formed in a shape projecting laterally. The hook portions 17 are engaged in the holes 18 of the base 13 while the holder 14 is inserted into the base 13. When the hook portions 17 are engaged in the holes 18 of the base 13, the holder 14 is regulated so that the holder 14 will not be detached from the base 13.

Figure 10:
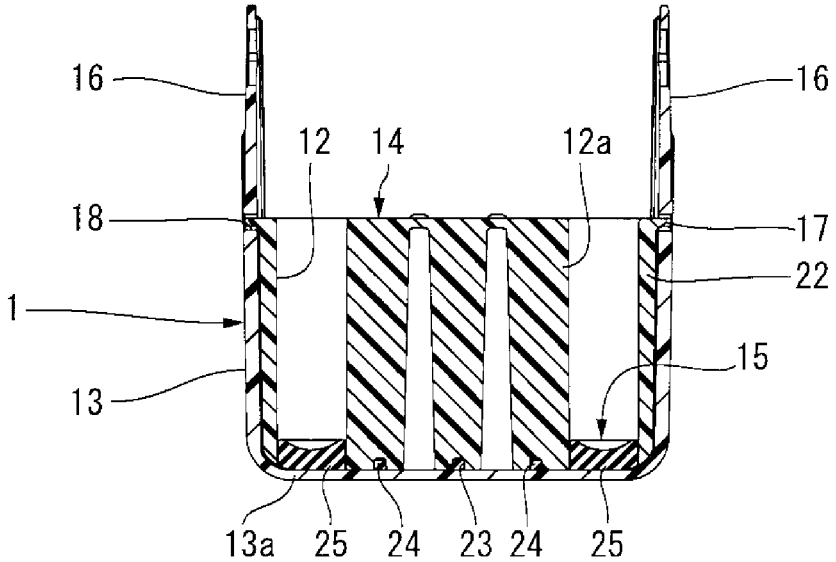
FIG. 10 is a sectional view taken along a line X-X in FIG. 9.
Figure 11:
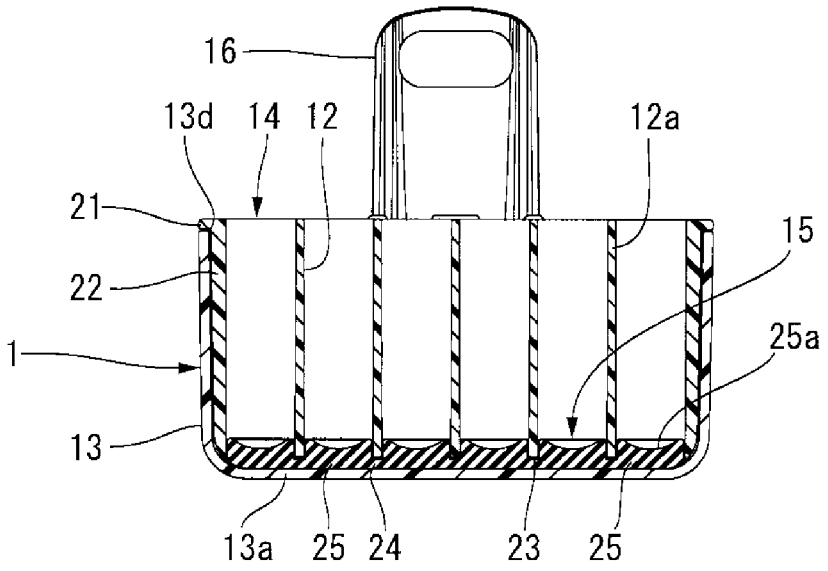
FIG. 11 is a sectional view taken along a line XI-XI in FIG. 9.

As shown in FIGS. 10 and 11, the holder main body 22 is formed in a shape that is fitted in the base 13. The holder main body 22 is detachably inserted into the base 13.

The plurality of tube holes 12 are formed in the upper plate 21 and the holder main body 22. The tube holes 12 are formed by through holes that are open to the holder upper surface 14*a* located on the tube insertion side and a holder bottom surface 14*b* (see FIG. 6) on the opposite side, and are arranged in a direction (horizontal direction) along the holder upper surface 14*a*. Note that the "holder upper surface" and the "horizontal direction" correspond to those in a state in which the tube rack 1 is mounted on the bucket 4 and stays still. The inner diameter of the tube hole 12 is slightly larger than the outer diameter of the tube 11.

The holder bottom surface 14*b* is formed in a shape in which the bottom rubber portion 15 (to be described later) is fitted. As shown in FIG. 6, a groove 23 connecting the adjacent tube holes 12 is formed in a portion serving as a hole wall 12*a* of the tube hole 12 in the bottom portion of the holder 14. The groove 23 is formed to accommodate a connecting piece 24 of the bottom rubber portion 15 (to be described later). In this embodiment, the groove 23 forms a "notch" of the invention described in claim 2.

As shown in FIGS. 5, 6, and 8, the bottom rubber portion 15 is formed by a plurality of bottom rubber members 25 and the connecting pieces 24 connecting the bottom rubber members 25. In this embodiment, the connecting pieces 24 form "connecting portions" of the present invention.

Each bottom rubber member 25 is formed in a columnar shape that is fitted in the tube hole 12 of the holder 14. More specifically, each bottom rubber member 25 is formed in a columnar shape in which an upper surface 25*a* (distal end surface) oriented to the opening of the tube hole 12 on the tube insertion side is located at one end in the axial direction.

The outer diameter of the bottom rubber member 25 is slightly smaller than the inner diameter of the tube hole 12. "Slightly smaller" indicates that the outer diameter is small to the extent such that a clearance which allows insertion and removal is formed with respect to the hole wall surface of the tube hole 12.

Figure 8A:
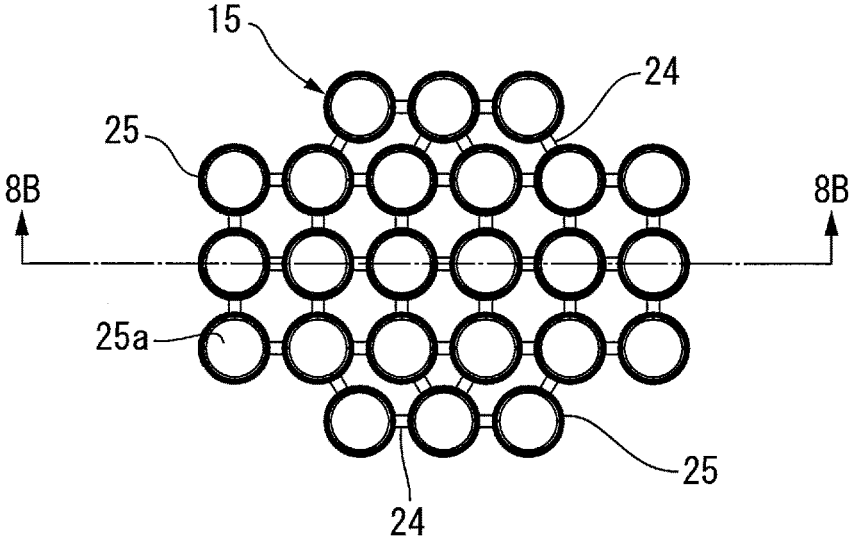
FIG. 8A is a plan view showing a bottom rubber portion.
Figure 8B:
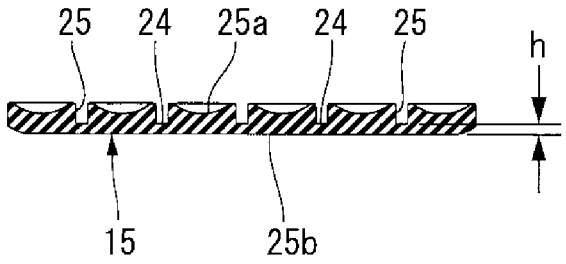
FIG. 8B is a sectional view taken along a line 8B-8B in FIG. 8A.
Figure 13:
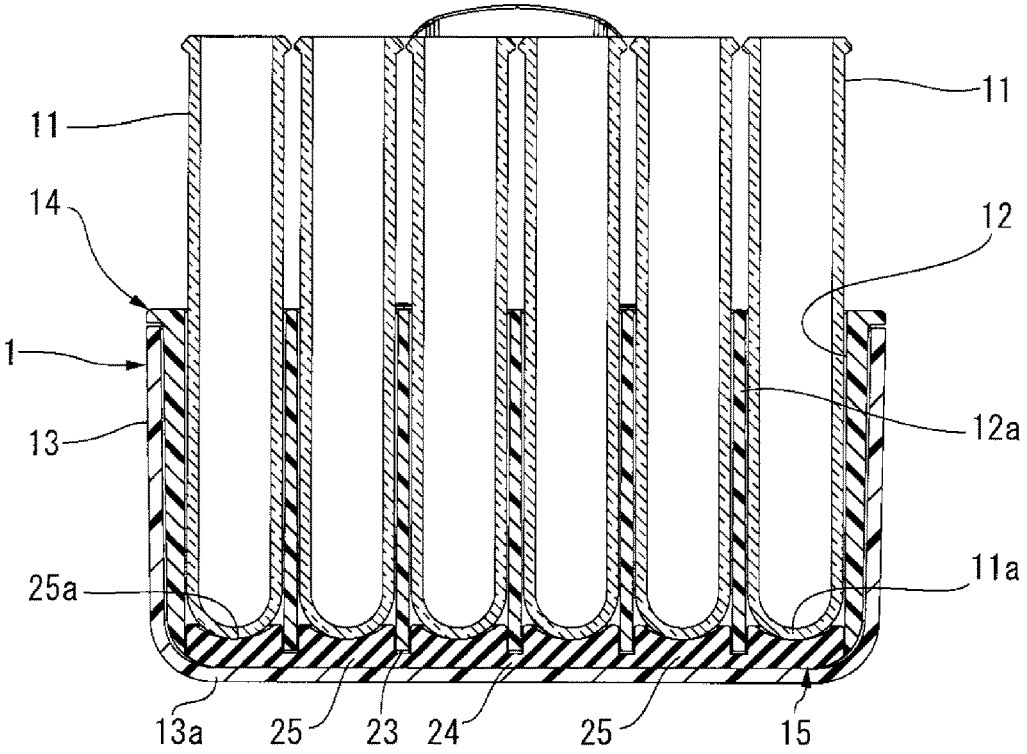
FIG. 13 is a sectional view taken along a line XIII-XIII in FIG. 12.

As shown in FIGS. 8B, 10, and 11, the central portion of the upper surface 25*a* of each bottom rubber member 25 is formed in a shape having a concave surface. As shown in FIG. 13, this concave surface is formed in a shape conforming to the outer surface of the bottom portion 11*a* of the tube 11.

Each connecting piece 24 projects outward in the radial direction from the outer surface of the bottom rubber member 25 to connect the adjacent bottom rubber members 25. More specifically, each connecting piece 24 is part of the outer surface of the bottom rubber member 25, and projects outward in the radial direction from a part that is located in the vicinity of a bottom surface 25*b* (see FIG. 6) on the opposite side of the upper surface 25*a* (distal end surface) in the axial direction of the bottom rubber member 25. Each bottom rubber member 25 according to this embodiment is connected to at least two adjacent bottom rubber members 25 by at least two connecting pieces 24.

Figure 8C:
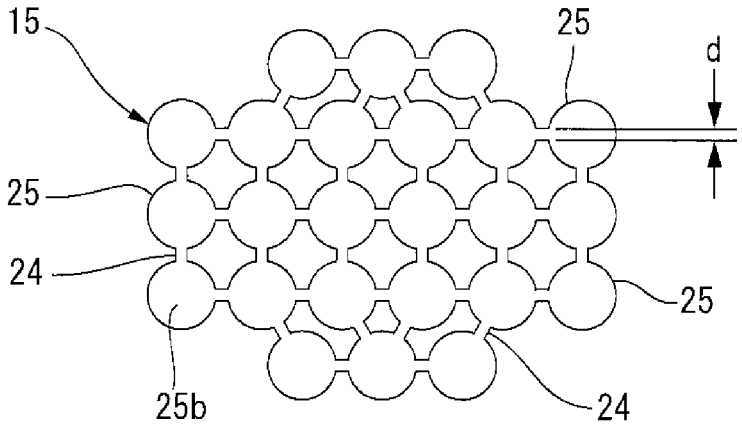
FIG. 8C is a bottom view showing the bottom rubber portion.

As shown in FIGS. 8A and 8C, a width d of each connecting piece 24 according to this embodiment is smaller than the width (outer diameter) of the bottom rubber member 25. As shown in FIG. 8B, a height h of the connecting piece 24 is equal to or smaller than half the length of the bottom rubber member 25 in the axial direction. That is, each connecting piece 24 is formed in a shape that has a width smaller than that of the bottom rubber member 2 and connects portions of a pair of adjacent bottom rubber members 25 up to about the middle positions in the axial direction from the bottom surfaces 25*b*. Each groove 23 of the holder 14 is formed at a position corresponding to the connecting piece 24. The depth of the groove 23 is a depth to accommodate the entire connecting piece 24.

Figure 9:
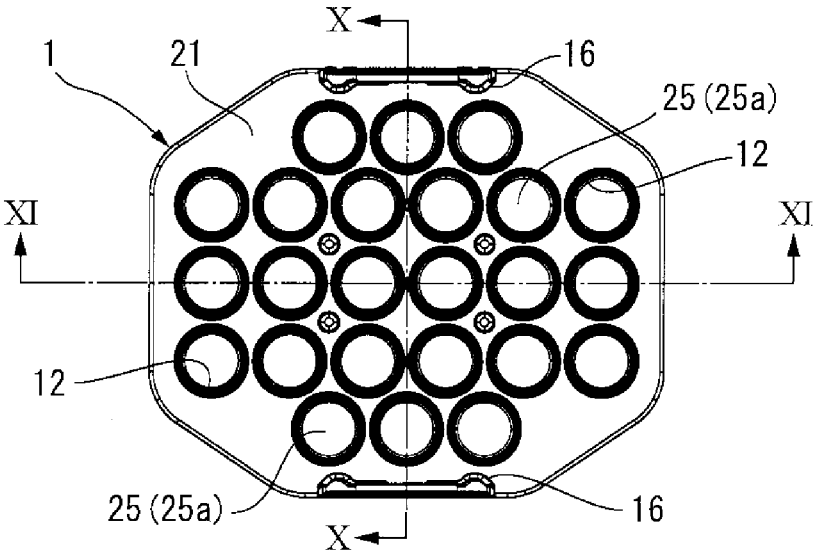
FIG. 9 is a plan view showing the tube rack.

To assemble the thus formed tube rack 1, the bottom rubber portion 15 is mounted on the bottom portion of the holder 14. The bottom rubber portion 15 is held by the holder 14 in a state in which the bottom rubber members 25 are fitted in the tube holes 12 and the connecting pieces 24 are accommodated in the grooves 23. Next, the holder 14 and the bottom rubber portion 15 are inserted into the base opening 13*d* from above. The hook portions 17 of the holder 14 are engaged in the holes 18 of the base 13. When the holder 14 is mounted in the base 13 in this way, the holder 14 is fixed to the base 13 in a state in which the base opening 13*d* is closed by the upper plate 21 of the holder 14 and the holder main body 22 abuts against the base bottom plate 13*a*, as shown in FIGS. 9 to 11.

In this assembly state, as shown in FIGS. 10 and 11, the connecting pieces 24 of the bottom rubber portion 15 are sandwiched between the grooves 23 of the holder 14 and the base bottom plate 13*a*, and thus the bottom rubber portion 15 is never removed upward.

Figure 12:
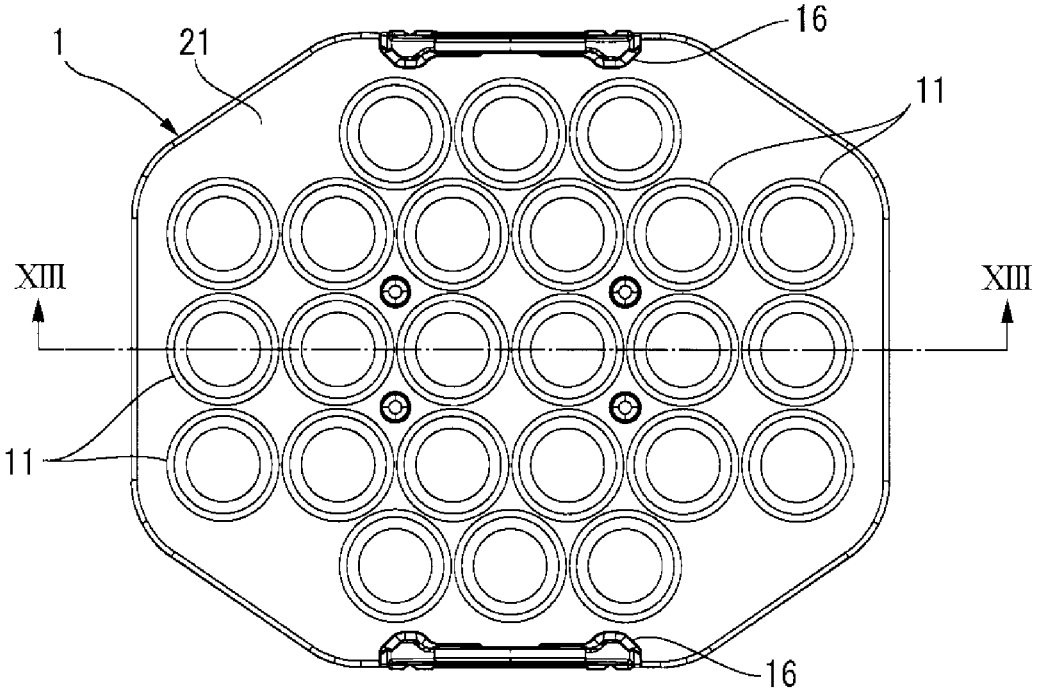
FIG. 12 is a plan view showing the tube rack into which the tubes are inserted.

The thus assembled tube rack 1 is inserted into the bucket 4 in a state in which the tubes 11 are inserted into the tube holes 12, as shown in FIGS. 12 and 13. The tubes 11 are supported by the bottom rubber members 25 in a state in which the bottom portions 11*a* contact the upper surfaces 25*a* of the bottom rubber members 25 and the hole walls 12*a* of the tube holes 12 regulate movement in the horizontal direction.

When the tube rack 1 is mounted on the bucket 4 and the swinging rotor 2 is rotated, the centrifugal force is applied to the bottom rubber portion 15 in a direction (the axial direction of the bottom rubber members 25) vertical to the tube rack 1. At this time, since the bottom rubber members 25 are inserted into the tube holes 12, deformation of the bottom rubber portion 15 caused by application of the centrifugal force to the bottom rubber portion 15 can be suppressed by the hole walls 12*a* of the tube holes 12. Furthermore, since the bottom rubber members 25 are inserted into the tube holes 12, the bottom rubber portion 15 never moves in the radial direction of the tube holes 12 with respect to the holder 14.

The reason why deformation and movement of the bottom rubber portion 15 are restricted will be described in more detail with reference to FIGS. 14 to 16.

In a state in which the swinging rotor 2 rotates at high speed, the bottom rubber members 25 are pressed in the above-described vertical direction by the tubes 11 applied with the centrifugal force. In this case, as shown in, for example, FIGS. 14 to 16, the deformation state of the bottom rubber portion 15 changes in accordance with the presence/absence of the walls surrounding the bottom rubber members 25. FIG. 14 is a sectional view showing a portion of the tube rack 1, where there is no groove 23. FIG. 15 is a sectional view showing a portion of the tube rack 1, where there is the groove 23. FIG. 16 is a sectional view when a bottom rubber portion 31 that is not inserted into the tube holes 12 is used.

Figure 14:
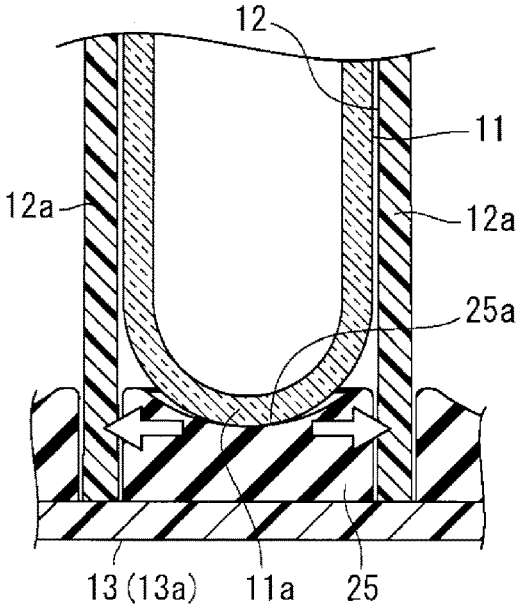
FIG. 14 is an enlarged sectional view showing a portion of the tube rack, where no groove is formed.

As shown in FIG. 14, if the centrifugal force in the vertical direction (axial direction) is applied to the bottom rubber member 25, the bottom rubber member 25 is surrounded by the hole wall 12*a* of the tube hole 12 and the bottom portion 11*a* of the tube 11, and thus has no room to deform. In this case, the concave shape of the upper surface 25*a* of the bottom rubber member 25 is maintained, and no excessive force is applied to part of the bottom surface of the tube 11, thereby preventing the tube 11 from being damaged.

Figure 15:
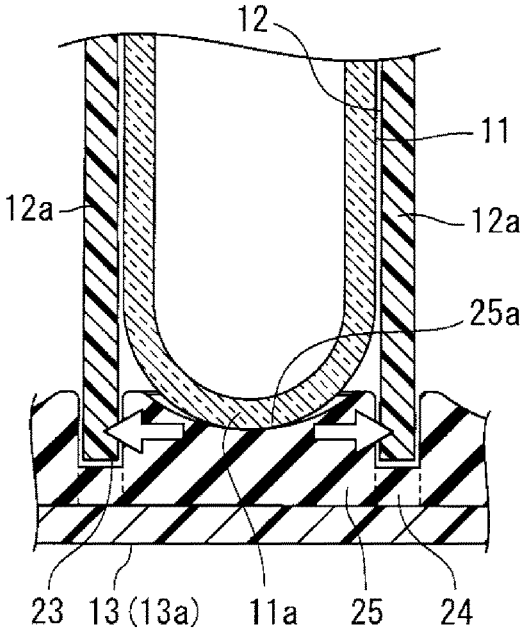
FIG. 15 is an enlarged sectional view showing a portion of the tube rack, where a groove is formed.

As shown in FIG. 15, if the height of the connecting piece 24 of the bottom rubber portion 15 is set to about half the height of the bottom rubber member 25, and the depth of the groove 23 of the holder 14 is set to a depth that can accommodate the connecting piece 24, the upper surface of the bottom rubber member 25 contacts the hole wall 12*a* of the tube hole 12 over the whole region in the circumferential direction. Therefore, in this case as well, the same effect as that obtained in the case shown in FIG. 14 can be obtained.

Figure 16:
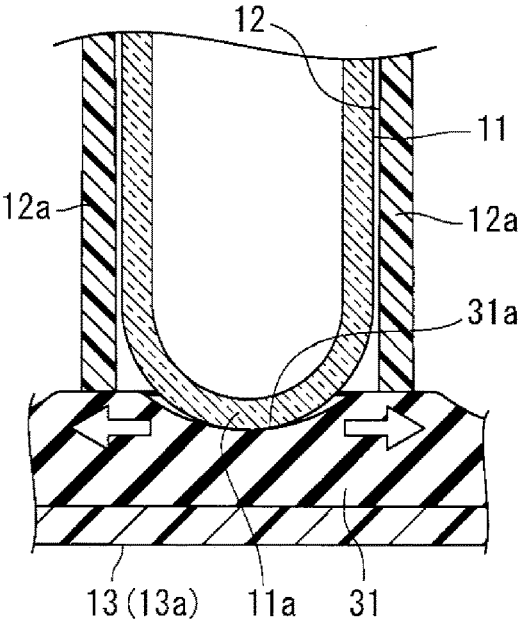
FIG. 16 is an enlarged sectional view showing a portion of the tube rack, where the bottom rubber portion is not inserted into the tube holes.

On the other hand, as shown in FIG. 16, in a case in which the bottom rubber portion 31 that is not inserted into the tube holes 12 is used, when the centrifugal force in the vertical direction is applied to the bottom rubber portion 31, the bottom rubber portion 31 has room to deform in the lateral direction since there is no wall (no hole wall 12*a* of the tube hole 12) in the lateral direction of the bottom rubber portion 31. In this case, the bottom rubber portion 31 has room to move in the lateral direction when an operation of tilting the tube rack 1 or the like is performed. As a result, the shapes and positions of the bottom portion 11*a* of the tube 11 and a concave surface 31*a* of the bottom rubber portion 31 do not coincide, and an excessive force is applied to part of the bottom portion 11*a* of the tube 11, thereby damaging the tube 11.

In the tube rack 1 according to this embodiment, the bottom rubber portion 15 having a structure in which the plurality of bottom rubber members 25 are connected by the connecting pieces 24 and being integrated is used. Therefore, as will be described later, it is possible to prevent the bottom rubber portion 15 from being separated, and readily perform an attachment operation or replacement operation of the bottom rubber portion 15.

[Bottom Rubber Portion Removal Prevention]

In this embodiment, the bottom rubber members 25 are inserted into the tube holes 12 from the side of the holder bottom surface 14*b*. Therefore, when the connecting pieces 24 abut against the hole walls 12*a* of the tube holes 12, it is possible to regulate the bottom rubber members 25 so that the bottom rubber members 25 do not come off from the tube holes 12. The structure for removal prevention does not rely on friction between the bottom rubber portion and the hole walls of the tube holes, unlike the conventional technique. Thus, even if the bottom rubber members 25 deteriorate over time, the bottom rubber members 25 will not come off. Therefore, it is possible to prevent the rotation of the swinging rotor 2 from becoming unbalanced caused by the loss of the bottom rubber members 25. As a result, it is possible to suppress a decrease in life of the motor for driving the swinging rotor 2.

[Ease of Attachment/Replacement of Bottom Rubber Portion (Improvement of Assemblability)]

In this embodiment, since the plurality of bottom rubber members 25 are connected by the connecting pieces 24 to form the one bottom rubber portion 15, it is unnecessary to insert each bottom rubber member 25 into each tube hole 12 when incorporating the bottom rubber members 25 in the holder 14. Therefore, even though the plurality of bottom rubber members 25 is provided, it is possible to provide the tube rack of the centrifugal separator, that has high assemblability.

An operation of replacing the deteriorated bottom rubber members 25 can be readily performed because by detaching the holder 14 from the base 13, the bottom rubber portion 15 can be exposed.

Therefore, according to this embodiment, it is possible to provide the tube rack of the centrifugal separator, in which the bottom rubber portion 15 can be readily mounted and readily replaced, and yet the bottom rubber portion 15 cannot be easily separated.

[Bottom Rubber Portion Displacement Prevention/Deformation Suppression]

Each bottom rubber member 25 according to this embodiment is formed in a columnar shape in which the upper surface 25*a* oriented to the opening of the tube hole 12 on the tube insertion side is located at one end in the axial direction. Each connecting piece 24 of the bottom rubber portion 15 is part of the outer surface of the bottom rubber member 25, and projects outward in the radial direction from a part that is located in the vicinity to the bottom surface 25*b* on the opposite side of the upper surface 25*a*, in the axial direction of the bottom rubber member 25. The grooves 23 that accommodate the connecting pieces 24 are formed in portions serving as the hole walls 12*a* of the tube holes 12 in the bottom portion of the holder 14.

Since the bottom rubber members 25 inserted into the tube holes 12 are held by the hole walls 12*a* of the tube holes 12 and the base bottom plate 13*a*, it is possible to prevent the bottom rubber portion 15 from being displaced.

Each connecting piece 24 is provided on the side of the bottom surface 25*b* on the outer surface of the bottom rubber member 25. Therefore, the distal end surface (upper surface 25*a*) of the bottom rubber member 25 contacts the hole wall 12*a* of the tube hole 12 over the whole region in the circumferential direction. As a result, when the tube 11 is pressed against the bottom rubber member 25 by the centrifugal force, the hole wall 12*a* of the tube hole 12 regulates deformation of the bottom rubber member 25 outward in the radial direction. Therefore, it is possible that the shape of the upper surface 25*a* of the bottom rubber member 25 supporting the bottom portion 11*a* of the tube 11 can be prevented from changing along with deformation of the bottom rubber member 25. As a result, it is possible to prevent an excessive force from being applied to part of the bottom portion 11*a* of the tube 11, thereby reliably preventing the tube 11 from being damaged.

[Suppression of Decrease in Strength of Holder}

In this embodiment, since each entire connecting piece 24 is accommodated in the groove 23 of the holder 14, a portion except for the grooves 23 in the bottom portion (holder bottom surface 14*b*) of the holder 14 readily contacts the base 13. This indicates that the area of the contact portion between the holder 14 and the base 13 increases, and the centrifugal force acting on the holder 14 at the time of rotation of the swinging rotor 2 can be received by a wide area of the base 13. Therefore, a decrease in strength of the holder 14 is suppressed, and it is possible to reliably prevent the holder 14 from being damaged by the centrifugal force.

[Effects on Adjacent Tubes and Sample Scattering Prevention]

The holder 14 includes the plurality of individual tube holes 12. Therefore, even if the tube 11 is damaged, this never has any effects on the adjacent tubes 11. Furthermore, the holder 14 and the bottom rubber portion 15 are covered with the base 13 from below and the side. Thus, even when the tube 11 is damaged, the sample is kept within the base 13, thereby preventing the sample from contacting the bucket 4 and the like. As a result, it is possible to prevent toxic substance and bacteria and the like from scattering.

EXPLANATION OF THE REFERENCE NUMERALS AND SIGNS

1 . . . tube rack, 4 . . . bucket, 11 . . . tube, 12 . . . tube hole, 12*a* . . . hole wall, 13 . . . base, 14 . . . holder, 15 . . . bottom rubber portion (bottom rubber main body), 23 . . . groove (notch), 24 . . . connecting piece (connecting portion), 25 . . . bottom rubber member

The invention claimed is:

1. A tube rack of a centrifugal separator, comprising:

a holder including a plurality of tube holes each configured to accommodate a tube that is used for a sample, and the plurality of tube holes each includes an opening at one end portion of the holder serving as a tube insertion side and an opening at a bottom portion of the holder that is at the other end;

a bottom rubber main body including a plurality of bottom rubber members, each member fits in the opening of the bottom portion of each of the plurality of tube holes, and including connecting portions each configured to connect the plurality of bottom rubber members that are adjacent to each other; and a base formed in a cylindrical shape that has a bottom configured to accommodate and detachably hold the holder and the bottom rubber main body, and to be inserted into a bucket of the centrifugal separator, each of the plurality of bottom rubber members is formed in a columnar shape in which a distal end surface oriented to the opening of the tube insertion side of the tube hole is located at one end in an axial direction, each of the connecting portions is part of an outer surface of each of the plurality of bottom rubber members, and is projected outward in a radial direction from a portion that is located in the vicinity of a bottom surface formed on an opposite side of the distal end surface, in the axial direction of the each of the plurality of bottom rubber members, and a notch configured to accommodate the each of the connecting portions formed in a portion that is the bottom portion of the holder serving as a hole wall of the each of the plurality of tube holes.

* * * * *